US009429393B2

(12) United States Patent
Graziano et al.

(10) Patent No.: US 9,429,393 B2
(45) Date of Patent: Aug. 30, 2016

(54) ILLUMINATED ARCHERY BOW SIGHT APPARATUS

(71) Applicant: Hoyt Archery, Inc., Salt Lake City, UT (US)

(72) Inventors: Mary Graziano, Huntsburg, OH (US); Dominic Graziano, Huntsburg, OH (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 0 days.

(21) Appl. No.: 14/965,295

(22) Filed: Dec. 10, 2015

(65) Prior Publication Data

US 2016/0169622 A1 Jun. 16, 2016

Related U.S. Application Data

(60) Provisional application No. 62/090,921, filed on Dec. 12, 2014.

(51) Int. Cl.

| | |
|---|---|
| ***F41B 5/14*** | (2006.01) |
| ***F41G 1/467*** | (2006.01) |
| ***F41B 5/10*** | (2006.01) |
| *F41G 1/34* | (2006.01) |

(52) U.S. Cl.
CPC ..... *F41G 1/467* (2013.01); *F41B 5/10* (2013.01); *F41G 1/345* (2013.01)

(58) Field of Classification Search
CPC ..... F41G 1/467; F41G 1/345; F41B 5/14
USPC ..... 124/23.1, 87; 33/265
See application file for complete search history.

(56) References Cited

U.S. PATENT DOCUMENTS 3,945,127 A * 3/1976 Spencer ..... F41G 1/467 33/265
4,177,572 A * 12/1979 Hindes ..... F41G 1/467 33/265
4,220,983 A * 9/1980 Schroeder ..... F41G 1/467 33/265
4,741,320 A * 5/1988 Wiard ..... F41B 5/1476 124/23.1
4,977,677 A * 12/1990 Troescher, Jr. ..... F41G 1/467 124/87
5,122,932 A * 6/1992 Ziller ..... F41G 1/467 124/87
5,152,068 A * 10/1992 Meister ..... F41G 1/467 124/87
5,339,227 A * 8/1994 Jones ..... F21V 33/008 124/87
5,435,068 A * 7/1995 Thames ..... F41G 1/467 124/87
5,791,060 A * 8/1998 Godsey ..... F41G 1/467 124/87
6,282,800 B1 * 9/2001 Beutler ..... F41G 1/467 124/87
6,477,780 B2 * 11/2002 Aldred ..... F41G 1/467 124/87
6,601,308 B2 * 8/2003 Khoshnood ..... F41G 1/467 124/87
6,725,854 B1 * 4/2004 Afshari ..... F41G 1/345 124/87

(Continued)

*Primary Examiner* — Alexander Niconovich
(74) *Attorney, Agent, or Firm* — Holland & Hart

(57) ABSTRACT

An illumination device for a sight guard and pin for an archery bow, crossbow, or similar weapon or firearm includes at least one fiber optic or other optic element that carries light from an onboard artificial light source to an arc or to pinpoints positioned around the perimeter or circumference of the sight guard. The tip of a sight pin in the sight guard may also be illuminated by the optic element. Light emitted from the optic element is blocked from shining in the direction of the target, but remains visible from the perspective of the shooter. The illumination device enables the user to see the shape of the sight guard and the relative position of the sight pin in low light conditions where reflective tape, glowing materials, and other conventional devices would be difficult to use. Methods of using and activating the illuminated sight guard are also disclosed.

20 Claims, 8 Drawing Sheets

(56) References Cited

U.S. PATENT DOCUMENTS

| | | | | |
|---|---|---|---|---|
| 6,796,037 | B1 * | 9/2004 | Geffers | F41G 1/467 124/87 |
| 6,802,129 | B1 * | 10/2004 | Wirth | F41G 1/467 124/87 |
| 7,029,141 | B1 * | 4/2006 | Skelly | F41G 1/467 33/265 |
| 7,082,690 | B1 * | 8/2006 | Khoshnood | F41G 1/467 124/87 |
| 7,089,698 | B2 * | 8/2006 | Afshari | A01K 85/01 250/459.1 |
| 7,100,291 | B2 * | 9/2006 | Afshari | F41G 1/467 124/87 |
| 7,503,122 | B2 * | 3/2009 | Afshari | F41G 1/467 124/87 |
| 7,503,321 | B2 * | 3/2009 | Afshari | F41G 1/345 124/87 |
| 7,549,230 | B2 * | 6/2009 | Rager | F41G 1/467 124/87 |
| 7,603,784 | B2 * | 10/2009 | Erhard | F41G 1/467 124/87 |
| 7,743,518 | B2 * | 6/2010 | Khoshnood | F41G 1/467 124/87 |
| 7,921,570 | B1 * | 4/2011 | Pulkrabek | F41G 1/467 124/87 |
| 8,151,473 | B2 * | 4/2012 | Sims | F41G 1/467 124/87 |
| 8,161,656 | B1 * | 4/2012 | Ellgass | F41G 1/467 124/87 |
| 8,171,648 | B2 * | 5/2012 | Summers | F41G 1/467 124/87 |
| 8,176,644 | B1 * | 5/2012 | Summers | F41G 1/467 124/87 |
| 8,272,137 | B2 * | 9/2012 | Logsdon | F41G 1/345 124/87 |
| 8,356,416 | B1 * | 1/2013 | Johnson | F41G 1/467 124/87 |
| 8,677,637 | B2 * | 3/2014 | Willis | F41G 1/467 124/87 |
| 8,713,807 | B2 * | 5/2014 | LoRocco | F41G 1/345 124/87 |
| 8,826,551 | B2 * | 9/2014 | Gibson | F41G 1/467 124/87 |
| 8,839,525 | B2 * | 9/2014 | Pulkrabek | F41G 1/467 124/87 |
| 9,134,095 | B1 * | 9/2015 | Mills | F41G 1/467 |
| 2002/0083602 | A1 * | 7/2002 | Slates | F41G 1/467 33/265 |
| 2003/0097760 | A1 * | 5/2003 | Slates | F41G 1/345 33/265 |
| 2008/0134526 | A1 * | 6/2008 | Christensen | F41G 1/35 33/265 |
| 2009/0193705 | A1 * | 8/2009 | LoRocco | F41G 1/30 42/123 |
| 2015/0267998 | A1 * | 9/2015 | Grace, Jr. | F41G 1/467 42/117 |

* cited by examiner

ILLUMINATED ARCHERY BOW SIGHT APPARATUS

CROSS REFERENCE TO RELATED APPLICATIONS

This application claims the benefit of priority from U.S. Provisional Application No. 62/090,921, filed 12 Dec. 2014, and entitled ILLUMINATED SIGHT GUARD APPARATUS, the disclosure of which is incorporated, in its entirety, by this reference.

TECHNICAL FIELD

The present disclosure generally relates to archery bow sight illumination devices configured to provide visual aid in low light conditions and particularly relates to illumination devices configured to affix to and illuminate the rim of an archery bow sight or similar sight alignment device in low light conditions.

BACKGROUND

Archery bows, crossbows, firearms, and similar devices are often equipped with a sight used to aid the shooter's aim. With respect to archery bows, one or more sight pins are typically provided to align the archery bow to a target at a given distance. The pins provide a reference point from which the shooter may gauge the path of a projectile when it is launched or fired. Archery bows in particular often use archery sights equipped with a pin guard that extends around relatively fragile sight pins in order to protect them from being damaged. A pin guard may also be used in a sight as an adjustment point for manually calibrating the alignment of the pin and/or peep sight of the bow in order to ensure accuracy while shooting.

Use of the sight pin and pin guard becomes difficult, however, in low light conditions, such as at dawn, dusk, or night time or while the shooter is positioned in a shaded or dark area such as inside a blind or surrounded by foliage. Thus, highly accurate shots may be difficult to make in low light conditions because of the difficulty of seeing the pin and the pin guard.

To help alleviate this problem, some conventional pin guards may feature a reflective tape, ultraviolet (UV) reactant material, or glow-in-the-dark markings to improve visibility of the ring around the sight pin in low light conditions. However, their effectiveness diminishes in common scenarios. The luminosity of a UV charge or glow-in-the-dark material depletes or degrades over time, such as while a hunter waiting in a natural or man-made blind, or due to the age of the glow material used. For its part, reflective tape needs a nearby artificial light source to be effective, which not practical to use in a blind and or when the hunter is trying to conceal his or her location out of a blind.

Some manufacturers have produced equipment with one or more conventional light sources positioned in the circumference of the pin guard that cast light on the pin to improve its low light visibility. The conventional light sources are usually incandescent and powered by a battery. In such devices, however, the light source is oriented to provide lighting solely to the sight pin(s), and thus the pin guard ring is not illuminated. Thus, the shooter is not given a reference point for the shooter against which to compare the sight pin within the sight guard. In addition, light output by these devices may also be undesirably visible from the target's side of the sight, revealing the shooter's position when the light is active.

Other sights have fiber optic strands wrapped around the pin guard ring that gather ambient light and then direct the light to illuminate a point on the sight pin or a portion of the pin guard, but these apparatuses require ambient light that is not readily available in a blind or in other dark areas where illumination is most important.

Accordingly, there is a need for improvements to lighted sight guards and sight pins that allow the shooter to accurately line up a shot in low light conditions.

SUMMARY

One aspect of the present disclosure relates to an archery bow having a lighted sight apparatus. The bow may comprise a handle riser, a set of limbs positioned at opposing ends of the handle riser, with the set of limbs being configured to store energy upon drawing the archery bow, a bowstring extending between ends of the set of limbs, and a sight assembly connected to the handle riser. The sight assembly may comprise a sight pin, a guard portion positioned around the sight pin, with the guard portion having an archer side configured to face toward an archer drawing the archery bow and having a target side configured to face away from the archer, an artificial light source, and an optic element at least partially positioned on the guard portion. The optic element may be configured to be illuminated by light from the artificial light source, wherein at least a portion of the optic element is visible from the archer side of the guard portion and the optic element is concealed from the target side of the guard portion.

The optic element may comprise at least one optical fiber that may have a terminal end directed to face out of the archer side of the guard portion. The at least one optical fiber may also comprise a plurality of optical fibers, with the plurality of optical fibers each having a terminal end and the terminal ends each being directed to face toward the archer and being spaced around the guard portion.

The bow may further comprise a lens, with the lens concentrating the light of the artificial light source into the optic element. The artificial light source may be positioned within the sight assembly or the handle riser. The optic element may have a curved or ring shape around the sight pin that is visible from the archer side of the guard portion. An arc of the curve or ring shape may be visible from the archer side of the guard portion. A plurality of separated points along the curve or ring shape may be visible from the archer side of the guard portion.

Another aspect of the disclosure relates to an illuminated pin sight, which comprises at least one sight pin, a pin guard having a circular or oval-shaped circumference around the at least one sight pin, with the pin guard having a first side and a second side and the second side being opposite the first side, at least one light-distributing optic positioned at a perimeter of the pin guard, a power source, and an artificial light source configured to emit light and to illuminate the at least one light-distributing optic upon activating the power source. The light may be visible from the first side of the pin guard but not from the second side of the pin guard.

The pin sight may be connected to a bow and the power source may be automatically activated upon drawing the bow. Alternatively, the power source may be activated by inertia or by a switch connected to a handle portion of a bow, wherein the power source is activated by grip pressure against the switch. The pin guard may comprise an outer pin guard connected to an inner pin guard, wherein at least one of the outer pin guard and the inner pin guard comprises at least one surface channel, with the at least one surface channel receiving the at least one light-distributing optic.

The at least one surface channel may direct an end of the at least one light-distributing optic in a direction parallel to a longitudinal axis of the outer pin guard or inner pin guard. The at least one surface channel may also comprise a spiral or helical shape.

Another aspect of the disclosure is related to an illuminated pin sight comprising at least one sight pin, a pin guard having a circular or oval-shaped circumference around the at least one sight pin, a first optic element positioned extending around a perimeter of the pin guard, a second optic element positioned extending through the at least one sight pin, a power source, and an artificial light source configured to emit light and to illuminate the first and second optic elements upon connection to the power source. The pin guard may prevent visibility of light emitted from the first optic element in a first direction extending away from the pin guard toward a target and may allow light from the first optic element to be visible in a second direction extending away from the pin guard and toward a user, and the at least one sight pin may prevent visibility of light emitted from the second optic element in the first direction and may allow light from the second optic element to be visible in the second direction.

A cover may be positioned external to the first optic element in the first direction. The cover may comprise a ring shape having a plurality of apertures. The pin sight may also have a sheath or coating around the first and second optic elements, with the sheath or coating preventing lateral dispersion of light from the first and second optic elements.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
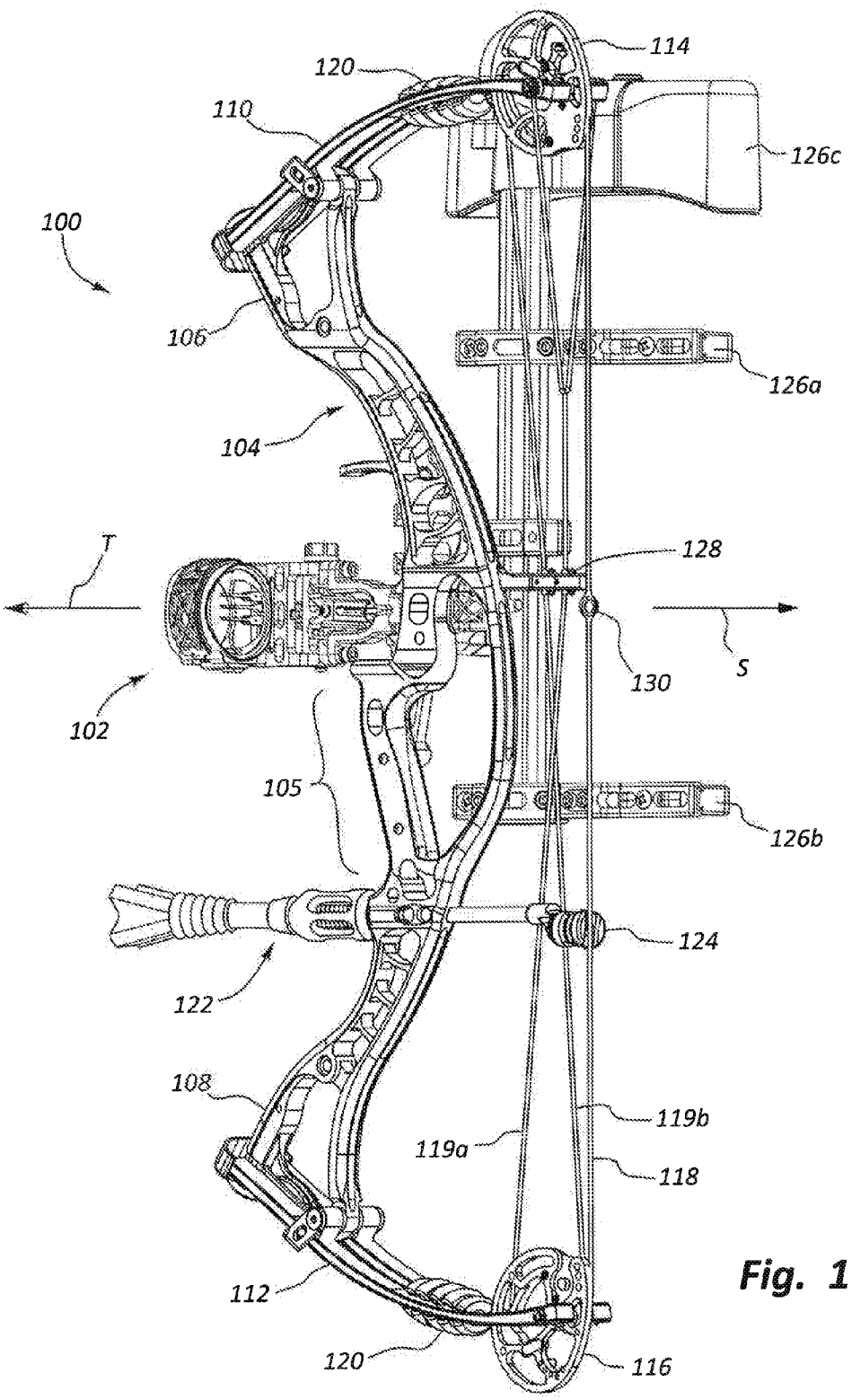
FIG. 1 is a perspective view of a bow having a sight apparatus according to an embodiment of the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to an illuminated sight guard apparatus that is configured to be affixed to or built into a round or oval sight guard. Embodiments of the illuminated sight guard apparatus may illuminate the circumference of the pin guard ring and at least one point on the sight pin of a conventional sight in low light conditions so that the sight remains visible and effective for use by the shooter. Particular detail is provided herein regarding a sight apparatus used with an archery bow, but those having ordinary skill in the art will understand and appreciate that the principles and features of the present embodiments may be easily transferred to other types of sights, such as crossbow sights, gun sights, scopes, or other related devices.

In an example embodiment, fiber optic strands, tubes, or cables are placed in the sight around the circumference or perimeter of a pin guard of a sight pin of a bow. They may also extend to or terminate at the tip of the sight pin. Other embodiments include fiber optics strands that are positioned on the sight in a manner directing their ends toward the shooter or directed along the firing axis of the bow. The ends of the strands may be evenly spaced around the circumference or perimeter. An artificial light source, such as, for example, a light bulb, may be attached to or embedded in the body of the sight assembly and may be positioned to cast light onto or into the fiber optic strands or tubing so that light is distributed throughout the fiber optics, thereby illuminating the sides and ends of the strands or tubing. In some embodiments, the fiber optics may be positioned so that when they are illuminated, the strands or the ends thereof are illuminated in lines, arcs, or points around the perimeter of the sight guard. A pinpoint at the tip of the sight pin may also be illuminated.

These embodiments may advantageously provide illumination of parts of the pin guard and pin of the sight apparatus under low light conditions, such as at dusk or dawn or when the shooter is in a blind or surrounded by thick cover. The fiber optics may be positioned in a manner concealing their light from the target side of the sight while directing ample visible light toward the shooter. Thus, the shooter may have maximum visibility of the sight without indicating the shooter's position on the target side of the sight.

The light source may comprise a light emitting diode (LED) or other compact and efficient artificial light source.

The light source may be powered by a battery (e.g., an alkaline or rechargeable DC battery) or other energy source stored in the sight guard or the handle riser of the bow. In some cases, the fiber optics, light source, and power source of the lighted sight may replace or supplement illumination features of existing light units for sight guards that only illuminate a sight pin. Accordingly, embodiments of the present disclosure may include devices configured to be used as a replacement or upgrade device or module to be installed in bows, crossbows, and/or firearms that employ conventional pin sights. However, other embodiments may encompass an entire sight assembly accessory that is connected to a bow or other device in place of an existing sight.

The artificial light source may also comprise a convex bulb or may be placed adjacent to a convex lens. Whether convex or not, the shape of the bulb or lens may focus or otherwise direct light emitted from the artificial light source into the end portions of the fiber optic strands (e.g., their terminal tip surfaces). This may improve the brightness of the sight and improve the contrast of the lighted portions of the sight against the surrounding sight portions or the ambient area by efficiently gathering light into the optic elements used in the sight without casting light on other portions of the sight (or bow).

Support or structural components in a container on the body of the sight housing or handle riser may hold the fiber optics in a predetermined orientation that maximizes their light gathering ability. For example, a rubber or other flexible material may be positioned to support the fiber optics in a position where their ends face the lens and light source. The light source may be contained within an opaque housing so that light that is not directed into the optic elements does not scatter to the bow's ambient surroundings. In some embodiments, fiber optic elements may be used that have their lengths contained in a sheath or opaque coating that prevents lateral emission of light, but their ends or tips are not covered at parts intended to be visible to the shooter.

In some embodiments, the sight guard may be configured with the lighted optic elements being visible to the archer/shooter without being visible from the target side of the sight. The lighted elements may therefore be obscured from a target's perspective while being visible from the shooter's perspective. The sight guard may have a first side facing away from the shooter and a second side facing toward the shooter, and the first side may have an obstruction or body portion of the sight that partially or entirely covers visibility of the optic element while the second side does not partially or entirely cover or block visibility of the optic element.

An archery bow (or other device to which the sight is attached) may have a line of sight extending through the pin of the sight and through the pin guard ring, and the lighted optic element may be visible from only one direction along that line of sight. In some embodiments, the visibility of the optic element may be defined by being concealed from a certain range of angles around the front/target side of the sight, such as being concealed within a 90, 120, 180, 270, or 330-degree three-dimensional spherical cone of view comparable shape) centered around the front of the sight, while the optic element may remain visible in the remaining field of view (i.e., the remaining three-dimensional space behind the sight). This way, the light aiding the shooter remains hidden from the target's perspective over a broad range of angles extending around the line of sight as well.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Turning now to the figures in detail, FIG. 1 shows an embodiment of an archery bow 100 having an illuminated pin sight 102 according to the present disclosure. The bow 100 may comprise a handle riser 104 having an upper end 106, a lower end 108, and a handle grip portion 105. Each of the ends 106, 108 may be respectively connected to upper limbs 110 and lower limbs 112. The ends of the limbs 110, 112 may be connected to wheels or cams 114, 116 around which a bowstring 118 and cables 119*a*, 119*b* may be routed. The bow 100 may be equipped with various accessories, including, for example, limb dampeners 120, a stabilizer 122, a string dampener 124, a mounted quiver 126*a*, 126*b*, 126*c*, a cable guard 128, and/or other related equipment. The bowstring 118 may be connected to a peep sight 130 that is configured for use with the illuminated pin sight 102.

The bow 100 may shoot an arrow or other projectile by positioning the arrow at an arrow support on the handle riser 104 and against the bowstring 118, drawing the bowstring 118, thereby storing energy in the limbs 110, 112, and then releasing the bowstring 118, thereby releasing the stored energy and launching the arrow forward and away from the bowstring 118 as the bowstring snaps back into its rest position.

As the arrow flies, its course may generally lie within an arc in a vertical plane in which the bowstring 118 lies. The back-and-forth movement of the bowstring 118 may also generally lie within this plane. Thus, this plane may be referred to as the "arrow plane," "arrow path plane," bowstring plane," or "bowstring path plane." The illuminated pin sight 102 and peep sight 130 may be calibrated to help the archer align the arrow plane with the target and to gauge how much aiming vertical tilt is needed to make the path of the arrow strike the intended target.

FIG. 1 also shows direction T, which indicates the "target direction" relative to the bow 100, and direction S, which indicates the "shooter direction" relative to the bow 100. The target direction T extends away from the shooter, and the shooter direction S extends toward the shooter. Alternatively, direction T may be referred to as extending away from the front of the bow 100 or shooter and direction S may be referred to as extending away from the rear or back of the bow 100 to the shooter. The target direction T and shooter direction S may both be positioned within the arrow plane and are generally perpendicular to the bowstring 118 at rest position. Alternatively, the target and shooter directions T, S may be positioned relative to an axis through the tip of a sight pin of the illuminated pin sight 102 (i.e., whether they are in-plane with the arrow plane or not).

As used herein, a component may be "connected" to another component by being attached to the other component by fasteners, interlocking parts, snap-fit elements, or other reversible attachment methods, by being attached to the other component by non-reversible attachment methods such as adhesives, welding, and similar methods, or by being integrated into and unitarily/seamlessly part of the other component such as by being milled, molded, or otherwise built into the other component. The illuminated pin sight 102 may be connected to the handle riser 104.

Figure 2A:
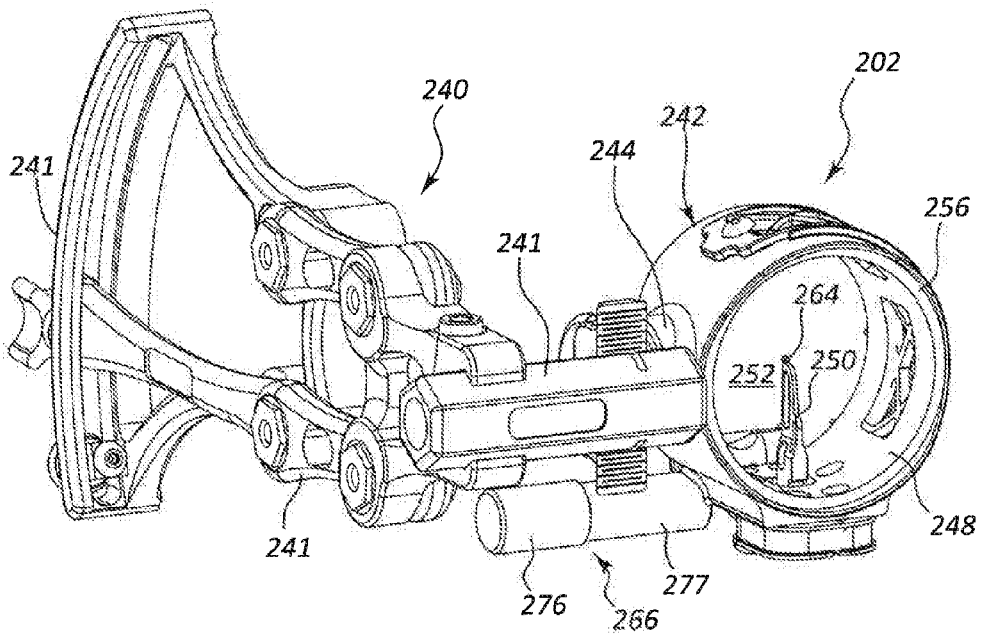
FIG. 2A is a front perspective view of a sight apparatus according to an embodiment of the present disclosure.
Figure 2B:
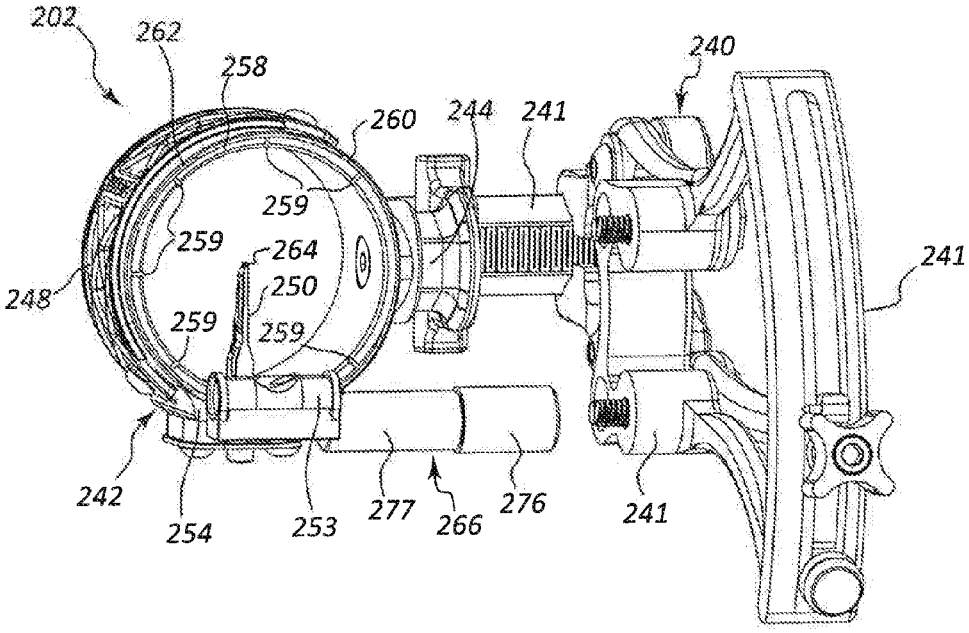
FIG. 2B is a rear perspective view of the sight apparatus of FIG. 2A.

FIGS. 2A-2B show detailed perspective views of an embodiment of an illuminated pin sight 202. The pin sight 202 may be the pin sight 102 of FIG. 1. FIG. 2A shows a front view (facing substantially in the shooter direction S, i.e., toward the shooter such that the front of the pin sight 202 is visible), and FIG. 2B shows a rear view (facing substantially in the target direction T, i.e., toward the target and such that the rear of the pin sight 202 is visible). The illuminated pin sight 202 may comprise a bracket portion 240 and a sight portion 242. The bracket portion 240 may be connected to a handle riser 104 and may comprise various adjustable and/or articulable components 241 that allow the user to adjust the position of the sight portion 242 relative to the bracket portion 240 and/or the handle riser 104. The bracket portion 240 may comprise at least one support arm 244 extending from the bracket portion 240 to the sight portion 242. The support arm 244 connects the bracket portion 240 to a pin guard ring 248 of the sight portion 242. The pin guard ring 248 may extend around one or more sight pins 250. The sight pin 250 may be connected to the pin guard ring 248.

The pin guard ring 248 may be generally tubular and may have a central sight opening 252 into which the sight pin 250 extends. The side of the pin guard ring 248 facing the shooter may be referred to as the shooter side or back side 254 of the pin guard ring 248 (see FIG. 2B), and the opposite side may be referred to as the target side or front side 256 of the pin guard ring 248 (see FIG. 2A). The central sight opening 252 may comprise a circumference or perimeter. An optic element 258 may extend around the circumference or perimeter on the back side 254 of the pin guard ring 248. In some embodiments, the optic element 258 may be positioned within a recess 260 in the back side 254. The recess 260 may be configured to hold the optic element 258 as it wraps around the central sight opening 252 while preventing light emitted from the optic element 258 from being visible from a lateral direction relative to the recess 260. For example, the recess 260 may be positioned adjacent to and within a circumferential wall 262 that is positioned radially outward from the central sight opening 252 and extends in the shooter direction S away from the recess 260. In some embodiments, a second circumferential wall (not shown) may be positioned radially internal to the recess 260 to block light from being cast in a radially internal direction from the optic element 258. For example, the second circumferential wall may prevent light from being cast radially and directly from the optic element 258 onto the sight pin 250 and its surroundings.

The optic element 258 may be visible to the shooter and may be illuminated to give the shooter a circumferential reference point for the sight pin 250. The sight pin 250 may also be illuminated, at least at its tip 264. Thus, the shooter may also be able to see the tip 264 relative to the circumferentially-positioned portions of the optic element 258 in low light conditions. In some embodiments, the optic element 258 may be routed around the circumference of the pin guard ring 248 and terminate with an end of the optic element 258 facing the shooter at the tip 264 of the sight pin 250. In other arrangements, the light at the tip 264 of the sight pin 250 may come from a source separate from the optic element 258.

In some configurations, the optic element 258 may be at least partially covered by a rear cover that is positioned in the shooter direction S away from the optic element 258 (e.g., so as to be positioned between the shooter and the optic element 258 and to partially block the shooter's view of the optic element 258). The rear cover may be connected to the pin guard ring 248. The rear cover may comprise a plurality of apertures, notches, or gaps that are configured to selectively let through some of the light from the optic element 258. For example, an aperture in the rear cover may be positioned at each of the top, bottom, and left and right sides of the rear cover in a manner that exposes a relatively small arc or pinpoint section of the optic element 258 to the view of the shooter. See also FIGS. 5C-5D and their associated descriptions below.

The optic element 258 may comprise a plurality of fiber optic strands or other refractive optical filaments or light-transmitting wire elements. Thus, the optic element 258 may be a translucent or transparent cylinder that is both flexible and solid. In one embodiment, the fiber optic strands may have a diameter of about 0.029 inches, but other sizes may be used depending on the size and design of the sight and pin guard ring being used. The fiber optic strands may be configured to gather light from an artificial light source at one end of the strands, to partially emit light laterally along their lengths, and to emit additional refracted light at their terminal ends. The optic element 258 may therefore be referred to as being internally illuminated from an end-positioned light source, as opposed to fiber optics used in conventional sights that are illuminated by ambient light that is gathered laterally through large portions of the lengths of the strands and then reflected from there toward the ends of the strands.

The light source may be focused into the optic element 258 to enhance the brightness of the sides and exposed end of the optic element 258. Focusing the light source may also improve efficiency of the light source, meaning that lower brightness (and thus lower power consumption) is needed at the light source to provide sufficient illumination of the optic element 258. The visible portions of the optic element 258 may be a light source in a dark area due to being illuminated by an artificial light source concealed within the illuminated pin sight 202. Thus, the optic element 258 may be visible in complete darkness where conventional sights would not be visible due to a lack of ambient light that would be gathered by fiber optics, would be used to charge a glow-in-the-dark material, or would be reflected by a reflective surface on the sight apparatus.

The optic element 258 may be mounted at multiple points around the circumference of the pin guard ring 248. For example, a plurality of brackets or clips 259 may hold the optic element 258 to the pin guard ring 248 at a plurality of circumferentially spaced apart points around the pin guard ring 248. The clips 259 may be transparent so that they do not disrupt the emission of light from the optic element 258. The clips 259 may comprise a metal or plastic material and may be configured to be fitted or spring loaded to the pin guard ring 248.

In some embodiments, the optic element 258 may be attached to the pin guard ring 248 continuously and/or uniformly along a length of the optic element 258, such as by being seated in a groove in the pin guard ring 248 that pinches against or locks to a length of the optic element 258. A groove or channel may be machined or molded into the pin guard ring 248 for this purpose. Similarly, a length of the optic element 258 may be held to the pin guard ring 248 by an adhesive. Thus, the optic element 258 may be prevented from falling off of or being substantially separated from the pin guard ring 248. This may help prevent light from escaping the optic element 258 in an undesired direction and may make the optic element 258 less susceptible to damage or dislodging. In some embodiments, the optic element 258 is provided separated from a pin guard ring, and the optic element 258 may be attached to the pin guard ring by the user. This may be beneficial to users that have irregularly-shaped pin guard rings, such as oval or polygonal pin guard rings, since the user may attach the optic element 258 around the perimeter of the irregular pin guard ring where needed.

One or more support arm 244 may be a housing for an artificial light source and/or power source used to illuminate the optic element 258. Thus, the support arm 244 may contain a cavity or internal container in which the ambient light source and power source may be contained. The power source may be connected or disconnected from the outside of the support arm 244 by a switch or movable part of the exterior of the support arm 244. See also FIGS. 2C-2D.

The pin guard ring 248 may comprise an opaque material that prevents transmission of light through the pin guard ring 248 in the target direction T. Thus, the pin guard ring 248 may prevent light emitted from the optic element 258 and artificial light source from being visible to a viewer at the front side 256 of the illuminated pin sight 202. For example, the pin guard ring 248 may comprise a metal such as aluminum, titanium, magnesium, an opaque polymer/plastic, a composite based on a material such as carbon fiber or fiberglass in an opaque matrix material, or a comparable material. Similarly, the sight pin 250 may comprise an opaque material that prevents light from an optic element (e.g., 258) extending through its shaft from being visible. The tip 264 of the sight pin 250 may, however, be transparent or may comprise openings that expose the optic elements 258.

Figure 2C:
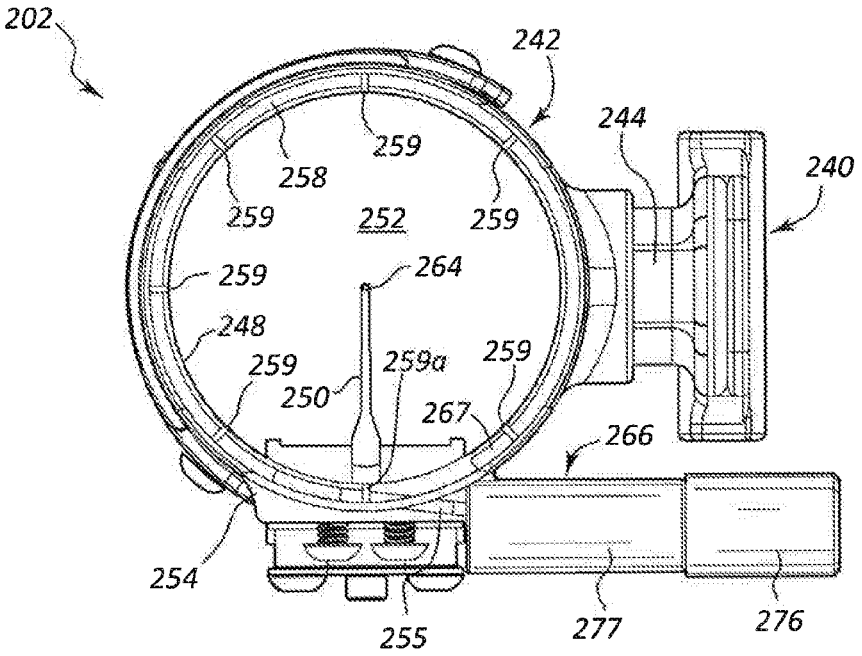
FIG. 2C is a rear end view of the sight apparatus of FIG. 2A.
Figure 2D:
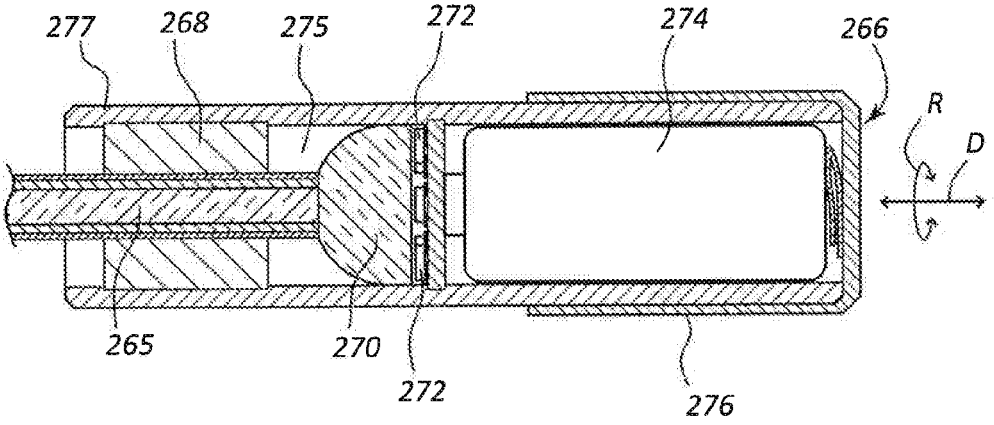
FIG. 2D is a partial section view of FIG. 2C.

Turning now to FIGS. 2C and 2D, the sight portion 242 of the illuminated pin sight 202 is shown with the bracket portion 240 and sight level 253 (see FIG. 2B) hidden. FIG. 2C shows a rear end view of the back side 254 and faces directly through the central sight opening 252, and FIG. 2D is a partial section view of the housing portion 266 of FIG. 2C.

The sight portion 242 is connected to a bow via the bracket portion 240. The bracket portion 240 comprises a single support arm 244 or bracket, and the lower portion of the sight portion 242 is connected to a free-extending housing portion 266. In some embodiments, the housing portion 266 may be structurally connected to the bracket portion 240 as well. The housing portion 266 extends substantially tangentially away from the circumference of the pin guard ring 248 at a lower end of the pin guard ring 248. The housing portion 266 is substantially cylindrical in shape. This positioning and shape configuration of the housing portion 266 may help to keep the housing portion from being exposed to impacts due to being positioned generally between the pin sight guard 248 and the handle riser of the bow. The positioning of the housing portion 266 may also allow the optic element 258 to be routed directly along a tangential path 255 into the housing portion 266. By following the tangential path 255 into the housing portion 266, the optic element 258 may retain more light and is under less stress and strain from bending.

The optic element 258 of the sight 202 that extends circumferentially around the pin guard ring 248 may have a terminal end 265 that is positioned within the housing portion 266, as shown in FIG. 2D. In some embodiments, the second terminal end 267 of the optic element 258 may also be positioned in the housing portion 266 adjacent to the first terminal end 265. The terminal end 265 may be held within the housing portion 266 by a support ring 268 so that the terminal end 265 is axially directed toward a focal point of a lens 270 focusing light from an artificial light source 272 within the housing portion 266. The housing portion 266 may also contain a power source, such as, for example, a battery 274 or array of batteries. The housing portion 266 may have an internal chamber 275 in which the terminal end 265, support ring 268, lens 270, and artificial light source 272 are positioned. The terminal end 265 may be positioned within the housing portion 266 and pin guard ring 248 up to the position on the pin guard ring 248 where it is exposed to the shooter, such as near the bottom-most oriented clip 259*a*. In this manner, the light coming from the optic element 258 is shielded from being visible from the target side of the sight portion 242.

The lens 270 may be a convex lens connected to or positioned adjacent to the artificial light source 272. The lens 270 may focus light from the artificial light source 272 into the terminal end 265 of the optic element 258. The lens 270 may therefore comprise a transparent material configured to refract light inward toward the interface between the optic element 258 and the lens 270.

The artificial light source 272 may comprise a light emitting diode (LED), incandescent bulb, or comparable lighting device that is compact and durable. The artificial light source 272 may beneficially generate a low amount of heat while being bright and energy efficient. In some embodiments, the artificial light source 272 may comprise a single light-emitting device, but other embodiments may comprise a plurality of light emitting devices that collectively emit light into the optic element 258.

The outer end 276 of the housing portion 266 may be movable relative to an inner tube 277 of the housing portion 266 and the pin guard ring 248. For example, the outer end 276 may be a switch that may be axially depressed (e.g., along direction D of FIG. 2D) to turn the artificial light source 272 on and off. Another example may include a switch that is activated by rotating the outer end 276 relative to the inner tube 277 (e.g., along direction R of FIG. 2D). In other embodiments, the outer end 276 may comprise a separate electrical switch or button that may be manipulated by the user to toggle power to the artificial light source 272.

The support ring 268 may comprise an elastic material configured to dampen vibration and other forces applied to the housing portion 266 so that the terminal end 265 of the optic element 258 is more resistant to breaking, cracking, or other damage. Thus, the support ring 268 may comprise a rubber or flexible polymer material. The support ring 268 may be configured to support the terminal end 265 around its circumference in all directions due to the terminal end 265 extending centrally through an aperture that extends through the support ring 268.

The tip 264 of the sight pin 250 may be centrally located within the ring generated by the optic element 258. See FIG. 2C. Alternatively, the tip 264 may be offset laterally or vertically relative to the center of the ring. In some embodiments, the tip 264 may have an adjustable position. In embodiments where the second terminal end 267 of the optic element 258 extends through the sight pin 250, the optic element 258 may have a small amount of slack in the pin guard ring 248 or the sight pin 250 so that second terminal end 267 and the sight pin 250 may be moved without damaging the optic element 258 or disrupting its visible position relative to the pin guard ring 248.

Figure 3A:
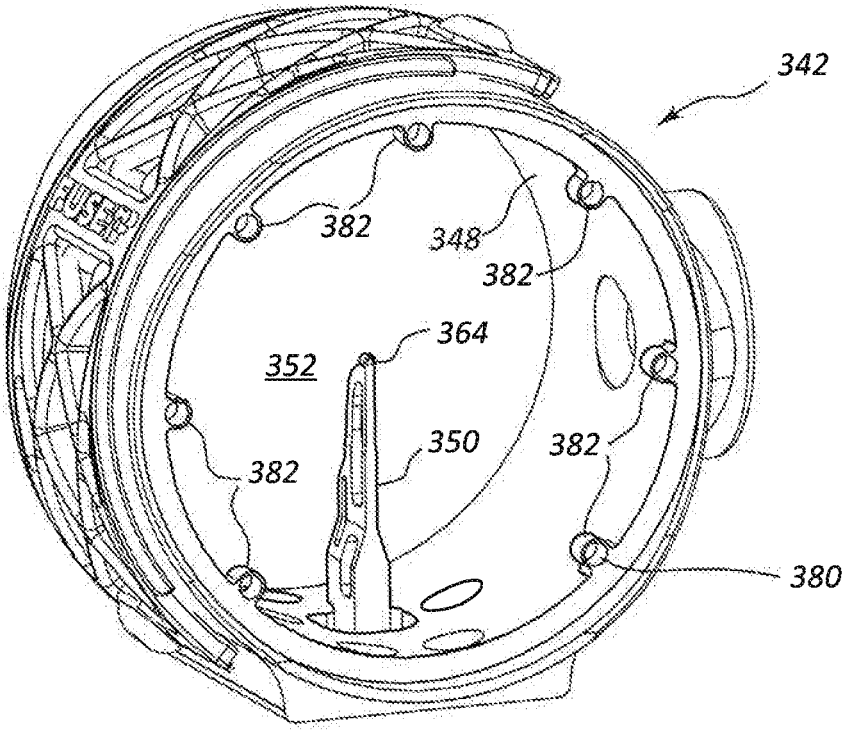
FIG. 3A is a rear perspective view of a sight apparatus according to another embodiment of the present disclosure.
Figure 3B:
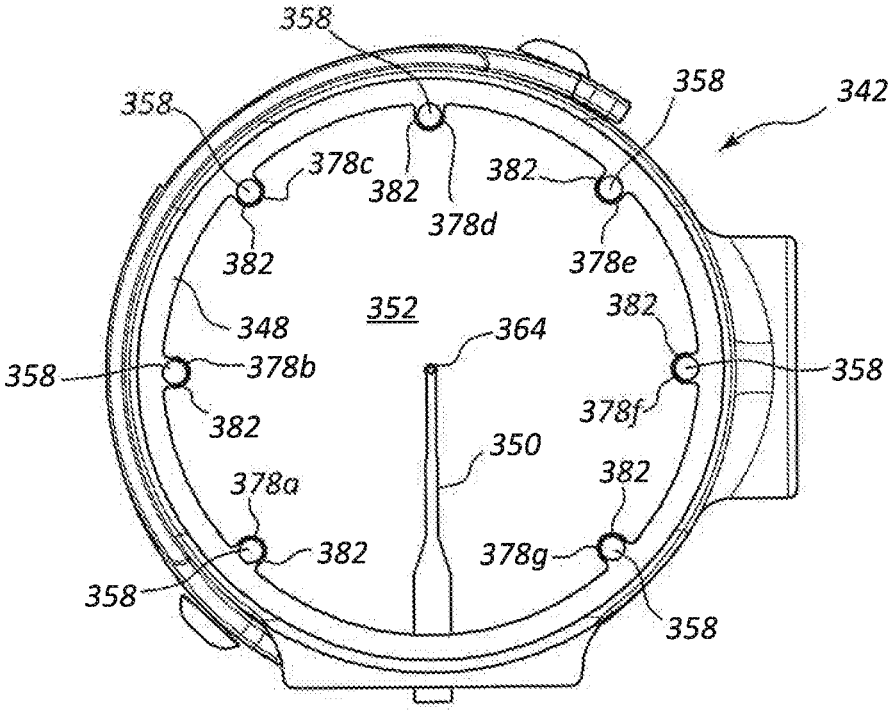
FIG. 3B is a rear end view of the sight apparatus of FIG. 3A.

FIGS. 3A-3B show another embodiment of a sight portion 342 of an illuminated pin sight of the present disclosure. The sight portion 342 includes a sight pin 350 within a central sight opening 352 of a pin guard ring 348. As with other embodiments shown herein, the sight portion 342 may be connected to a bracket portion and/or a handle riser. The sight portion 342 may also be connected to a housing portion (e.g., housing portion 266) having a light source, power source, and other associated components described above. In this embodiment, however, the optic element may comprise a plurality of optic elements (not shown) that each receive light from a common light source (which may be in a housing portion) but then each terminate at different circumferential positions (378*a* through 378*g*) spaced around the pin guard ring 348. See FIG. 3B. At each of the circumferential positions 378*a*-378*g*, the individual optic elements may have a terminal end that faces toward the shooter direction S and away from the target direction T. Thus, light in the optic elements may be at least primarily emitted from the optic elements toward the shooter and not toward the target. Holes (e.g., 380) may be formed (e.g., drilled or molded) in a plurality of tabs 382 that extend radially inward from the inside perimeter of the pin guard ring 348, and the optic elements may be mounted in the tabs 382 by a press fit/friction fit, adhesive, or comparable method.

Figure 4A:
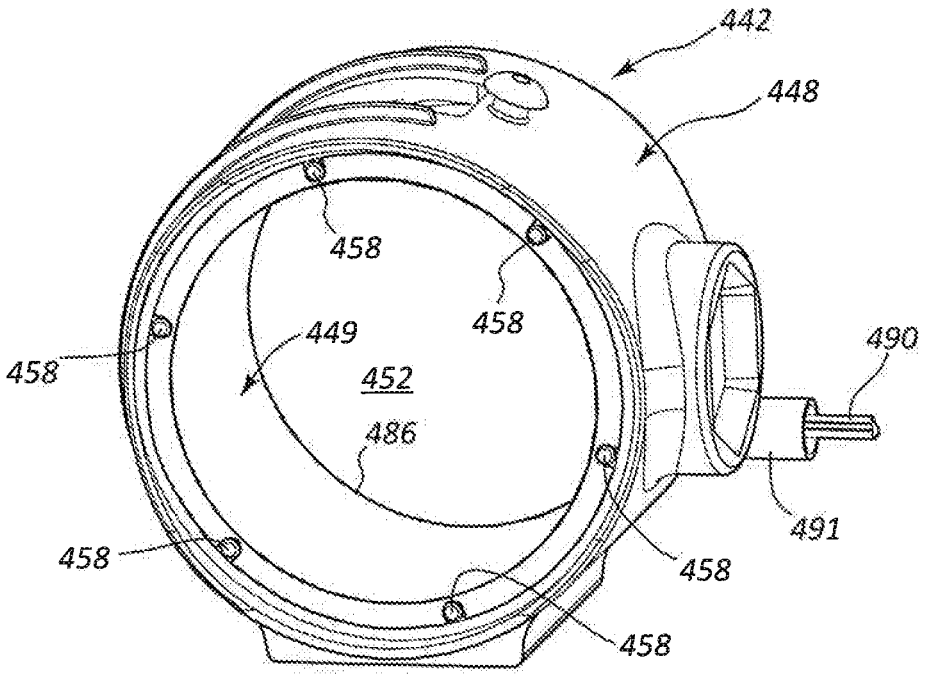
FIG. 4A is a rear perspective view of a sight apparatus according to another embodiment of the present disclosure.
Figure 4B:
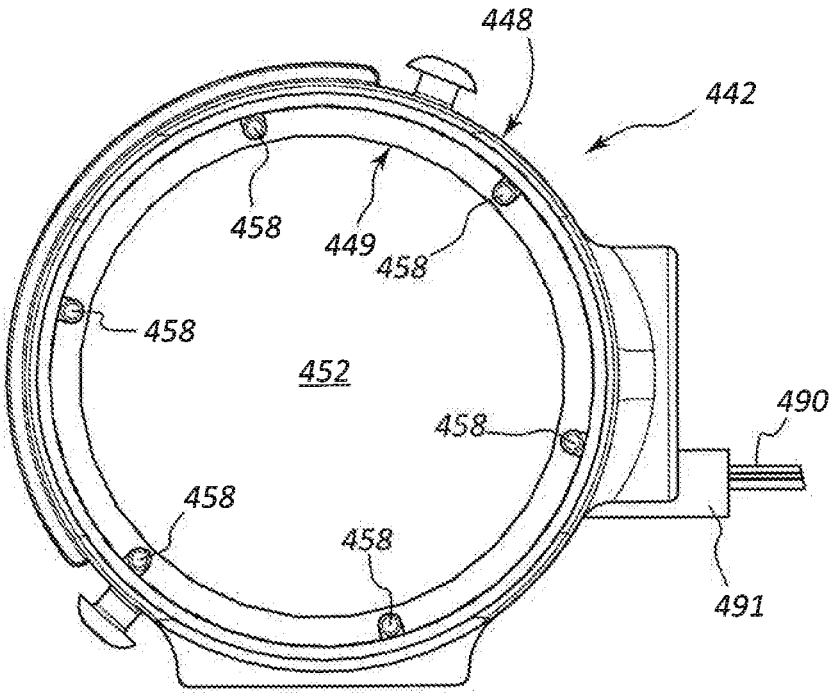
FIG. 4B is a rear end view of the sight apparatus of FIG. 4A.

In FIGS. 3A-3B, seven circumferential positions 378*a*-378*g* are shown, but in other embodiments, other numbers of configurations are possible. For example, the sight may comprise only circumferential positions 378-*b*, 378-*d*, and 378-*f* which, in conjunction with the tip 364 of the sight pin 350, would form an inverted "T"-shape for targeting in low light conditions. Similarly, circumferential positions 378*a*, 378*c*, 378*e*, and 378*g* may be used with the tip 364 to form an "X"-shape or cross shape. Additionally, a sight may comprise a larger number of lighted circumferential positions or tabs 382 and the positions of the circumferential positions 378 and tabs 382 may be changed relative to the pin guard ring 348. The tabs 382 of FIG. 4B are shown having even circumferential spacing between positions along a majority of the circumference of the pin guard ring 348 (with the exception of the space between positions 378*a* and 378*g*), but uneven spacing may be implemented, such as an embodiment where only positions 378*b*, 378*c*, 378*e*, and 378*f* are provided and/or illuminated. In some arrangements, the user may reposition strands of optic elements between the tabs 382 or remove some optic elements entirely to change the number and positioning of the illumination points around the sight.

The optic elements around the pin guard ring 348 may have an opaque outer coating or sheathing material that minimizes light escaping laterally through the optic elements in areas where they are routed to the tabs 382 or would be visible from the target side of the sight portion 342. Thus, the light in the optic elements may be laterally concealed while still being emitted from open and uncovered end tips. Alternatively, the optic elements may be routed through a passage within the pin guard ring 348 that prevents light from escaping in the target direction T from the sight.

FIGS. 4A-4D show yet another embodiment of a sight portion 442 of an illuminated pin sight of the present disclosure. In this embodiment, the sight portion 442 may comprise an outer pin guard ring 448 and an inner pin guard ring 449. The outer pin guard ring 448 may receive the inner pin guard ring 449 at a position radially internal to and contacting an inner tubular surface 451 (see FIG. 4C). The outer pin guard ring 448 may be attached to the inner pin guard ring 449 with optic elements 458 positioned in between. The outer and inner pin guard rings 448, 449 may comprise an opaque material that keeps the optic elements 458 concealed from vision except at their terminal ends that face toward the shooter.

Figure 4C:
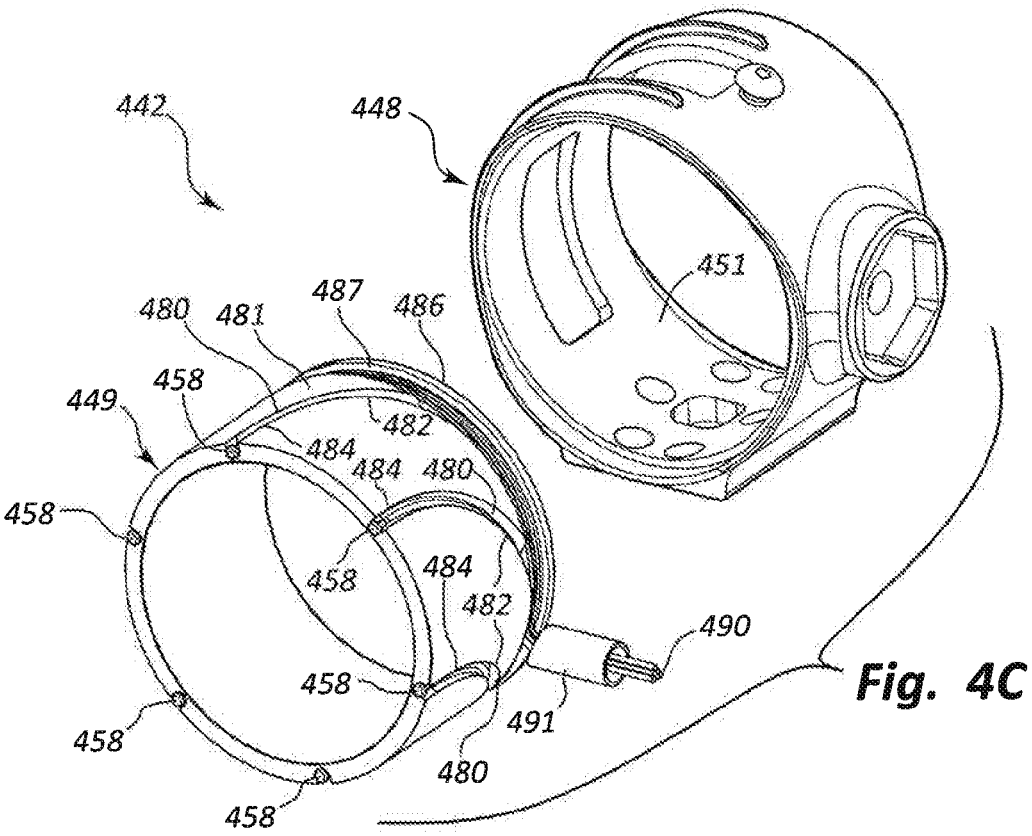
FIG. 4C is an exploded view of the sight apparatus of FIG. 4A.
Figure 4D:
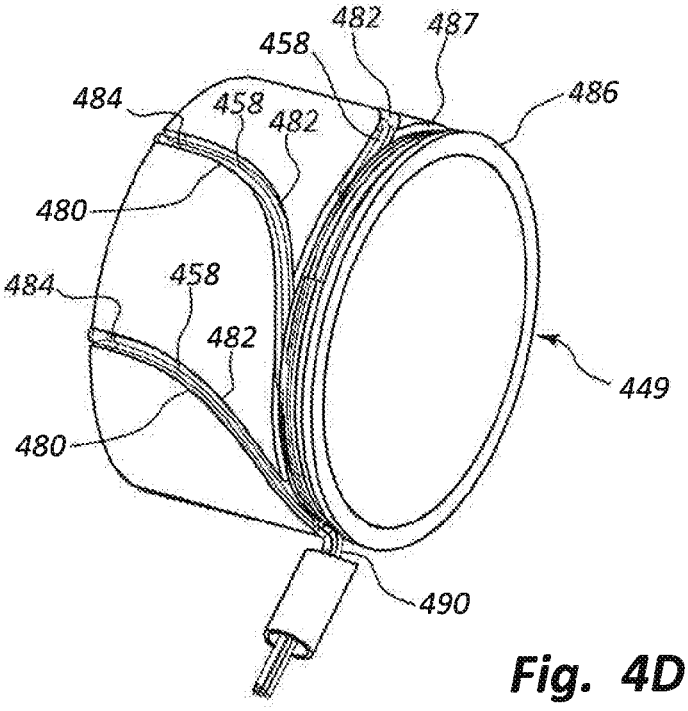
FIG. 4D is a perspective view of the inner pin guard ring of the sight apparatus of FIG. 4A.

The inner pin guard ring 449 may comprise a plurality of surface channels 480 in which the optic elements 458 are routed, as shown in FIGS. 4C-4D. In other embodiments, the outer pin guard ring 448 may have the surface channels 480 formed therein. The surface channels 480 may be sized with a width and depth to receive the optic elements 458 internal to the outer surface 481 of the inner pin guard ring 449 so that they can fit internal to the outer pin guard ring 448. In some embodiments, openings or apertures may be formed in the inner pin guard ring 449 to allow a sight pin or other components to penetrate through the inner pin guard ring 449 from the outer pin guard ring 448. In some arrangements, a sight pin may also be connected to the inner pin guard ring 449 and extend inward from the inner surface of the inner pin guard ring 449.

The surface channels 480 may each comprise a curved portion 482 and a straight portion 484. A straight portion 484 may hold a terminal end of an optic element 458 and may thereby keep the end oriented parallel to the shooting axis of the central sight opening 452 so that light from the optic elements 458 is directed primarily toward the eyes of the shooter. The curved portion 482 may direct the optic element 458 through a gradual spiral, helical, or coil-shaped path in order to avoid sharp bends in the optic element 458 that may break the optic element 458 or diminish its light-transmitting capability. The front end of the curved portion 482 may open in a direction substantially parallel to a front surface 486 of the inner pin guard ring 449. See FIG. 411). From that point, the optic elements 458 may all be coiled and routed around the perimeter of the central sight opening 452 within a circumferential groove 487 to a light source that is in the sight (e.g., a housing portion 266), the handle riser, or another portion of the device to which the sight is connected. A plurality of optic elements 490 are shown bunched together as they extend from the sight portion 442 through a protective tube 491 that may be connected to the outer pin guard ring 448. Thus, the circumferential groove 487 may receive optic elements 458 from each of the surface channels 480 without exposing the optic elements 458 to the target side/front surface 486 of the inner pin guard ring 449. The outer pin guard ring 448 may prevent their exposure in a radially outward direction as well.

In some configurations, the straight portion 484 of each surface channel 480 extends along a length of the inner pin guard ring 449 between the front and back surfaces of the inner pin guard ring 449, such as about half the length between the front and back surfaces, and the curved portion 482 has a tighter radius of curvature than that shown in the figures. In other embodiments, the curvature of the curved portion 482 is configured to have the end of an optic element 458 in the curved portion terminate facing parallel to the central sight opening 452 without extending through a straight portion 484.

Each of the surface channels 480 may have the same shape and size, but may be circumferentially spaced around the inner pin guard ring 449. In FIGS. 4A-4D, the surface channels 480 are spaced about 60 degrees apart from each other around the circumference of the inner pin guard ring 449, but other angles of separation may be used in different sights, such as in sights where more or fewer than six optic elements 458 are used. For example, four or eight evenly circumferentially spaced optic elements 458 may be used. The optic elements 458 may be positioned so that an aperture through the inner pin guard ring 449 that is used to facilitate extension of a sight pin from the outer pin guard ring 448 and the central sight opening 452 does not expose one of the optic elements 458.

Figure 5A:
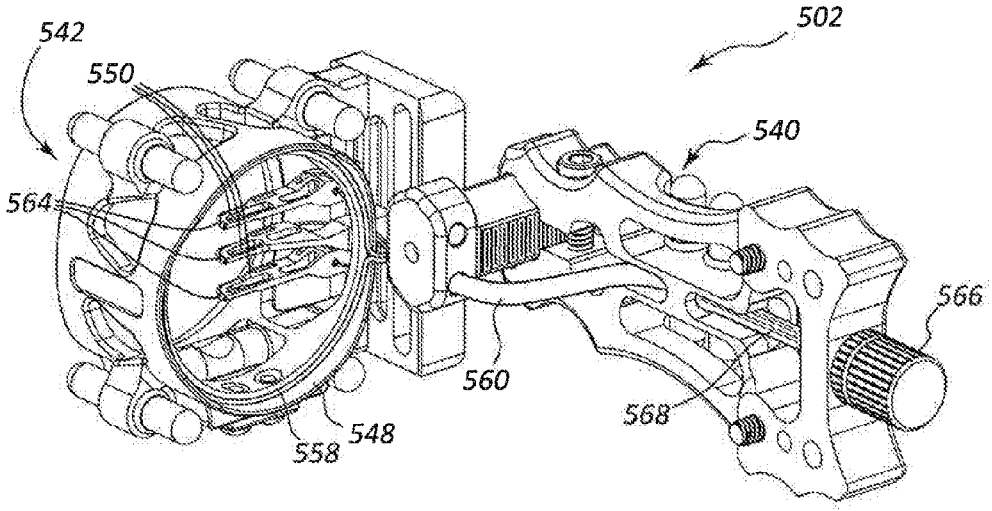
FIG. 5A is a perspective view of another embodiment of a sight apparatus according to the present disclosure.
Figure 5B:
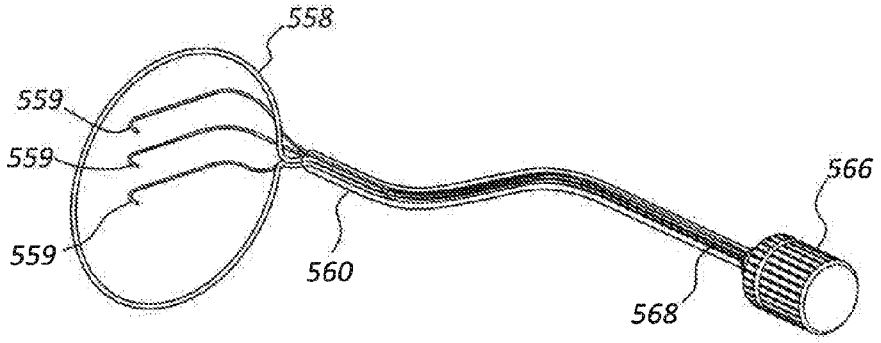
FIG. 5B is a view of certain optic elements of the sight apparatus of FIG. 5A.

FIGS. 5A-5B show yet another embodiment of a pin sight 502 of the present disclosure. The pin sight 502 comprises a bracket portion 540 and a sight portion 542. The sight portion 542 comprises a plurality of sight pins 550 that each have a lighted tip 564. The sight portion 542 also has a pin guard ring 548 extending around the sight pins 550. A circumferential optic element 558 may extend around the circumference of the rear side of the pin guard ring 548, and a plurality of pin optic elements 559 may light the tips 564 of the sight pins 550. FIG. 5B shows the circumferential optic element 558 and plurality of pin optic elements 559 isolated from the pin sight 502.

In this pin sight 502, each of the optic elements 558, 559 may be configured with a different color, brightness, or on/off setting. The circumferential optic element 558 may comprise a thicker fiber optic wire than each of the plurality of pin optic elements 559 in order to be more laterally visible as it extends around the perimeter of the pin guard ring 548. The optic elements 558, 559 may have individual light sources in the light source housing 566 or they may be illuminated by the same light source. This pin sight embodiment 502 also shows that the optic elements 558, 559 may be routed to a light source that is external to the sight portion 542, such as to the light source housing 566 on the bracket portion 540. Alternatively, the light source housing 566 may be located elsewhere on a handle riser or other portion of the device to which the pin sight 502 is connected.

The circumferential optic element 558 and plurality of pin optic elements 559 may be routed into a tubing or sheath 560 that protects and guides the optic elements 558, 559 to a light source housing 566 from which their terminal ends 568 are lighted. The sheath 560 may be transparent, translucent, or opaque. If the sheath 560 is transparent or translucent, the bracket portion 540 may be configured with structural features that block any light emitted through the sheath 560 from the optic elements 558, 559 in the target direction T so that the light is not visible from the target side of the pin sight 502.

Figure 5C:
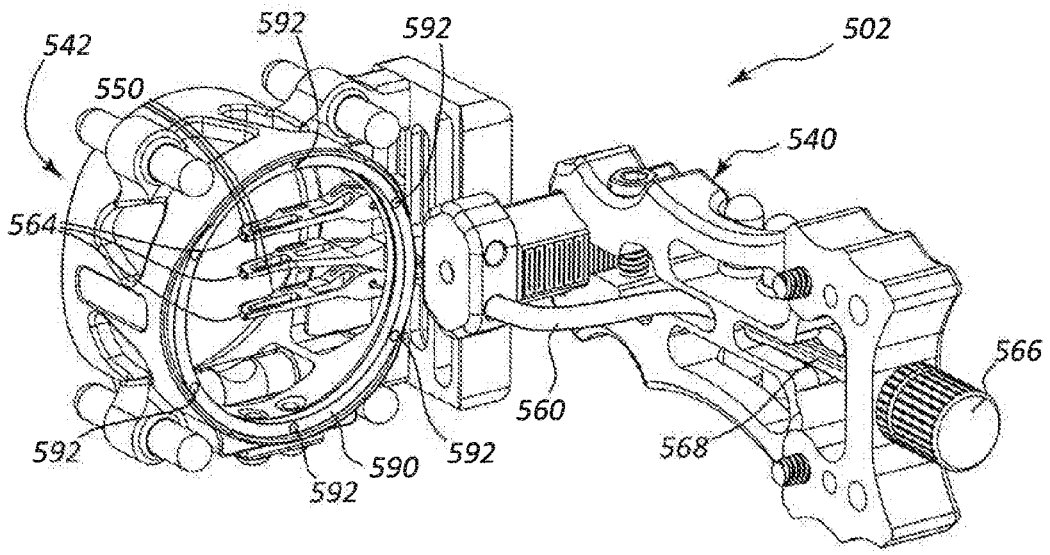
FIG. 5C is a perspective view of yet another embodiment of a sight apparatus according to the present disclosure.

FIG. 5C shows another embodiment of the pin sight 502 wherein a cover ring 590 is included. The cover ring 590 is attached to the sight portion 542 adjacent to and rearward relative to the circumferential optic element 558 in a manner that causes it to lie between the circumferential optic element 558 and the shooter. The cover ring 590 may be substantially opaque.

The cover ring 590 comprises a plurality of circumferentially spaced-apart apertures 592. In some embodiments, the apertures 592 may contain transparent material that makes the apertures 592 into small windows. The apertures 592 are configured to allow light from the circumferential optic element 558 to be selectively visible to the shooter at specific spaced-apart positions around the circumference of the pin guard ring 548. Thus, with the cover ring 590 installed, the circumferential optic element 558 may only be visible to the shooter through the apertures 592. By using a cover ring 590, the sight portion 542 may emit less light toward the shooter, which may help preserve the shooter's night vision and make the ring around the sight dim er a d less distracting. The visible points of light around the ring 590 may also be used as reference points against which the sight pin and target may be compared. The cover ring 590 also allows multiple segregated and separated points of light to be presented to the shooter without needing the sight to have a plurality of lighted fiber optic wires. A single circumferential optic element 558 may be used to shine through several or all of the apertures 592. In some arrangements the cover ring 590 may be rotatable relative to the sight portion 542 so that the positions of the apertures 592 may be rotated to different positions relative to the sight portion 542 and the sight pins 550. The cover ring 590 may be used in addition to, or in place of, clips (e.g., clips 259), grooves, or adhesives in order to hold the circumferential optic element 558 in position relative to the pin guard ring 548.

Figure 5D:
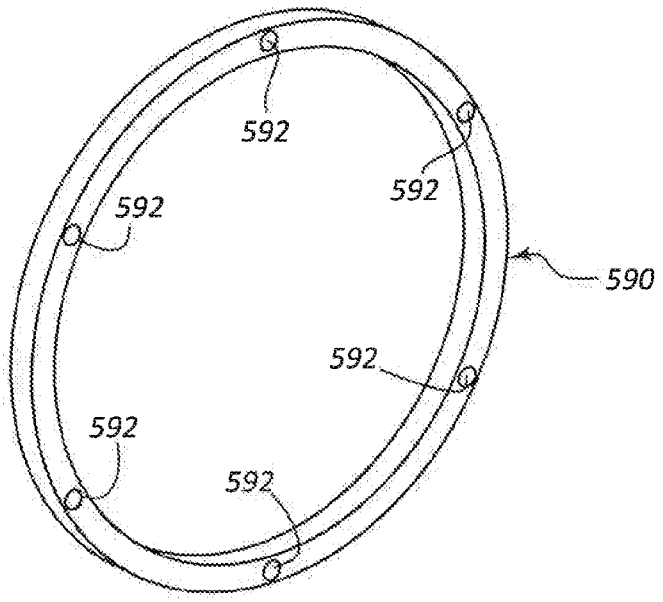
FIG. 5D is a view of a cover ring of the embodiment of FIG. 5C.

The apertures 592 in the cover ring 590 are circular in shape in FIGS. 5C and 5D. In some cases, the apertures 592 may each have a short but continuous arc shape, such as a curved rectangular strip shape, that follows the curvature of the cover ring 590. Thus, rather than revealing a circular point of light from the circumferential optic element 558, the apertures 592 may each reveal an arc-shaped segment of the circumferential optic element 558. While FIGS. 5C-5l) show an embodiment where the cover ring 590 has six apertures 592, a larger or smaller number of apertures 592 may also be used.

Some features of embodiments of sights described herein may be constructed as part of an accessory that is attachable to an existing sight pin guard. For example, the present embodiments may be constructed with a pin guard ring that is attachable to the shooter-facing side of a pin guard ring and a light source and power source that are attachable to the sight (or the weapon used with the sight). A pin guard ring of those embodiments may be adhered to the pin guard ring on the inside or outside of the hollow shape of the pin guard ring.

Various methods may be used to activate illumination of the optic elements of the embodiments disclosed herein. For example, the light source may be connected to an automatic switch or trigger that turns on the light source and illuminates optic elements in response to a user drawing a bowstring of a bow to which the sight is connected. The automatic switch or trigger may activate based on a variety of activators, such as, for example, receiving threshold strain measurements obtained from strain gauges on the limbs of the bow, detecting movement or rolling movement of the bowstring, cables, and/or cams of the bow, detecting a triggering of a pressure switch in the grip portion of the handle riser, and/or obtaining a threshold measurement from an accelerometer or other inertial sensor that detects the positioning of the bow relative to gravity or relative to a rest position. Thus, some methods of illumination may comprise at least: (1) detecting the position or orientation of the sight (or the position or orientation of the bow to which the sight is connected), (2) determining that the position or orientation of the sight coincides with an aiming position of the bow, and (3) activating the light source (e.g., connecting a power source to the light source). In some cases, the position or orientation of the sight may be detected simply by a switch being triggered, as in the case of a pressure switch in the grip that is triggered when the bow is being gripped (or when the bow is being gripped and the bowstring is drawn, due to increased pressure against the grip). Thus, the first and second steps listed above may be simultaneously performed. In some embodiments, these methods may further comprise detecting the position or orientation of the sight being out of an aiming position of the bow and deactivating the light source in response. An "aiming position" may be an upright or raised position of the bow or sight or may be a position where the shooter is holding the bow in a manner preparing to shoot a projectile.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including" and "having" come as used in the specification and claims shall have the same meaning as the term "comprising."

What is claimed is:

1. An archery bow having a lighted sight apparatus, the archery bow comprising:

a handle riser;

a set of limbs positioned at opposing ends of the handle riser, the set of limbs being configured to store energy upon drawing the archery bow;

a bowstring extending between ends of the set of limbs;

a sight assembly connected to the handle riser, the sight assembly comprising:

a sight pin;

a guard portion positioned around the sight pin, the guard portion having an archer side configured to face toward an archer drawing the archery bow and having a target side configured to face away from the archer;

an artificial light source;

an optic element at least partially positioned on the guard portion, the optic element configured to be illuminated by light from the artificial light source, the optic element comprising a visible portion, the visible portion being visible from the archer side of the guard portion, the visible portion being positioned on a perimeter of the guard portion, the optic element being concealed from view when the sight assembly is viewed from the target side of the guard portion.

2. The archery bow of claim 1, wherein the optic element comprises at least one optical fiber.

3. The archery bow of claim 2, wherein the at least one optical fiber has a terminal end directed to face out of the archer side of the guard portion.

4. The archery bow of claim 2, wherein the at least one optical fiber comprises a plurality of optical fibers, the plurality of optical fibers each having a terminal end, the terminal ends each being directed to face toward the archer and being spaced around the guard portion.

5. The archery bow of claim 1, further comprising a lens, the lens concentrating the light of the artificial light source into the optic element.

6. The archery bow of claim 1, wherein the artificial light source is positioned within the sight assembly or the handle riser.

7. The archery bow of claim 1, wherein the optic element has a curved or ring shape around the sight pin that is visible from the archer side of the guard portion.

8. The archery bow of claim 7, wherein an arc of the curved or ring shape is visible from the archer side of the guard portion.

9. The archery bow of claim 7, wherein a plurality of separated points along the curved or ring shape are visible from the archer side of the guard portion.

10. An illuminated pin sight, comprising:

at least one sight pin;

a pin guard having a circular or oval-shaped circumference around the at least one sight pin, the pin guard having a first side and a second side, the second side being opposite the first side;

at least one light-distributing optic positioned at a perimeter of the pin guard, the at least one light-distributing optic having a visible portion positioned at the perimeter, the visible portion being visible from the first side of the pin guard;

a power source;

an artificial light source configured to emit light and to illuminate the at least one light-distributing optic upon activating the power source, wherein upon activating the power source the light is visible from the first side of the pin guard at the visible portion of the at least one light-distributing optic at the perimeter of the pin guard, but the light is not visible from the second side of the pin guard upon activating the power source.

11. The illuminated pin sight of claim 10, wherein the pin sight is connected to a bow and the power source is automatically activated upon drawing the bow.

12. The illuminated pin sight of claim 10, wherein the power source is activated by inertia.

13. The illuminated pin sight of claim 10, further comprising a switch connected to a handle portion of a bow, wherein the power source is activated by grip pressure against the switch.

14. The illuminated pin sight of claim 10, wherein the pin guard comprises an outer pin guard connected to an inner pin guard, wherein at least one of the outer pin guard and the inner pin guard comprises at least one surface channel, the at least one surface channel receiving the at least one light-distributing optic.

15. The illuminated pin sight of claim 14, wherein the at least one surface channel directs an end of the at least one light-distributing optic in a direction parallel to a longitudinal axis of the outer pin guard or the inner pin guard.

16. The illuminated pin sight of claim 14, wherein the at least one surface channel comprises a spiral or helical shape.

17. An illuminated pin sight, comprising:

at least one sight pin;

a pin guard having a circular or oval-shaped circumference around the at least one sight pin;

a first optic element positioned extending around a perimeter of the pin guard;

a second optic element positioned extending through the at least one sight pin;

a power source;

an artificial light source configured to emit light and to illuminate the first and second optic elements upon connection to the power source;

wherein the pin guard prevents visibility of light emitted from the first optic element in a first direction extending away from the pin guard toward a target and allows light from the first optic element to be visible in a second direction extending away from the pin guard and toward a user;

wherein the at least one sight pin prevents visibility of light emitted from the second optic element in the first direction and allows light from the second optic element to be visible in the second direction.

18. The illuminated pin sight of claim 17, further comprising a cover positioned external to the first optic element in the first direction.

19. The illuminated pin sight of claim 18, wherein the cover comprises a ring shape having a plurality of apertures.

20. The illuminated pin sight of claim 17, further comprising a sheath or coating around the first and second optic elements, the sheath or coating preventing lateral dispersion of light from the first and second optic elements.

* * * * *